United States Patent [19]

Chaudorge

[11] 4,298,306

[45] Nov. 3, 1981

[54] APPARATUS FOR LOADING SOLID MATERIAL INTO A CONTAINER

[75] Inventor: Emile Chaudorge, Angerville, France

[73] Assignee: Chauoronnerie Tolerie Industrielle d'Angerrville "CTIA", France

[21] Appl. No.: 75,759

[22] Filed: Sep. 14, 1979

[30] Foreign Application Priority Data

Sep. 18, 1978 [FR] France ..... 78 26669

[51] Int. Cl.[3] ..... B65F 3/00

[52] U.S. Cl. ..... 414/525 R; 414/472

[58] Field of Search ..... 414/472, 525 R, 293

[56] References Cited

U.S. PATENT DOCUMENTS 3,297,180 1/1967 Park et al. ..... 414/525
4,029,224 6/1977 Herpich et al. ..... 414/525
4,057,157 11/1977 Park et al. ..... 414/525 X
4,065,008 12/1977 Ratledge ..... 414/525
4,073,393 2/1978 McKenzie et al. ..... 414/525

*Primary Examiner*—Trygve M. Blix
*Assistant Examiner*—L. E. Williams
*Attorney, Agent, or Firm*—Ostrolenk, Faber, Gerb & Soffen

[57] ABSTRACT

An apparatus for loading solid material into a receptacle or container, according to a four-phase cycle, comprises a loading blade for pushing material into the container and driving apparatus for operating the blade. The upper part of the blade and its driving apparatus are connected to a transverse beam running in a curved guide located in a vertical plane. The apparatus is particularly applicable to the compression of charges of material, particularly such as industrial or domestic waste, in a fixed or movable container or skip.

10 Claims, 6 Drawing Figures

APPARATUS FOR LOADING SOLID MATERIAL INTO A CONTAINER

BACKGROUND OF THE INVENTION

The invention forming the subject of the present description relates to an apparatus for loading charges of solid material into a container. More particularly, it relates to an apparatus for pushing such charges into and compressing them in a hopper or skip. This invention is applicable to all kinds of fixed or movable containers or hoppers intended to receive various materials and, in particular, to those which serve as receptacles for industrial or domestic waste materials.

The various devices utilized up to the present for loading solid charges into and compacting them in containers are well known. In general, they comprise more or less complicated assemblies, which are heavy and of quite costly construction. These assemblies comprise a plate or shutter, serving as a blade for pushing the charges into the receptacle, and means, in particular jacks or piston/cylinder units, for operating the blade. Typical devices of the prior art utilize an arrangement of connecting rods or chains on toothed wheels to operate the apparatus, which makes the device cumbersome and fragile. In other known techniques, cables are provided or frames are hinged at the base in a hopper or, again, vertical guides are used, all of which means make the construction quite complicated and cumbersome.

SUMMARY OF THE INVENTION

The present invention provides an improvement which gives a marked simplification in the loading device. It dispenses with the use of the customary arrangements and allows the construction of devices for loading or compressing various materials which are strong, simple and reliable in operation. These advantages are obtained in an unexpected manner by mounting the means for operating the loading blade below this blade, connecting it to a beam which slides in a curved guide located in the upper part of the assembly. Until now in similar devices, as for example those which are described in Swiss Patent Specification 516452 and French Published Applications 2189280 and 2218260, the cylinder units operating the blade have always been located above it. Also, guides for the beam carrying the blade, where provided in the prior art, have been straight and have traversed the lower part of the assembly.

As in the known arrangements, there are in the apparatus according to the invention, a plate or shutter forming the loading blade and driving means for imposing on this blade the necessary movements. The driving means are mounted with respect to the blade in such a manner that it effects the complete cycle of loading the material into the receptacle, with compaction, in four distinct successive phases. Starting from the position where the receptacle is closed by the blade, the movements of the cycle are: first, raising the blade to a high position, substantially uncovering the entry into the receptacle; second, lowering the blade until its lower edge reaches the surface from which the charge is pushed into the receptacle; third, sweeping or scraping this surface towards the entry to the receptacle with the blade; fourth, raising the blade and closing the opening of the receptacle with it.

The structure according to the invention allows the harmonious realization of the above-mentioned cyclic movements and is characterised in that the driving means for the blade have their points of attachment below the blade and are connected to a transverse beam sliding on a curved guide situated in a vertical plane between the blade and the entry of the receptacle to be charged. The curvature and length of the guide, as well as the lengths of the movable parts of the driving means, determine the four successive positions of the blade in the operating cycle. The movable beam is located at the top of a discharging bay mounted at the rear of the vehicle. The guide is in general an arc of a circle having its concavity towards the entry to the receptacle, and it extends from a point situated at the top of the apparatus, in the vicinity of the receptacle itself, to the bottom adjacent the central region of the apparatus.

As the driving means in general comprise jacks or piston and units in devices of the type of the invention, the practical form of construction of them comprises hydraulic or electric cylinders for operating the blade. One of the ends of each cylinder is hingedly connected to the movable beam, as it also represents the height of the blade.

According to a particular feature of the invention, the blade is provided with two cylinders or two groups of parallel cylinders. The end of the body of one of them is connected to a hopper or to a support fixed to the base of the container, while the end of the piston rod of the second cylinder is hinged to the blade itself, towards the middle of its height.

One preferred embodiment of the invention is illustrated, without limitation of the scope of the invention, in the following description.

BRIEF DESCRIPTION OF THE DRAWINGS

The accompanying drawings, wherein like reference numerals denote like elements, show diagrammatically the rear part of a receptacle, at the entry to which is mounted a bay comprising an apparatus according to the invention. This receptacle can, for example, be constituted by the body or hopper of a vehicle for collecting and transporting various solid materials or it can be a stationary assembly.

DETAILED DESCRIPTION OF THE PREFERRED EMBODIMENT

Figure 1:
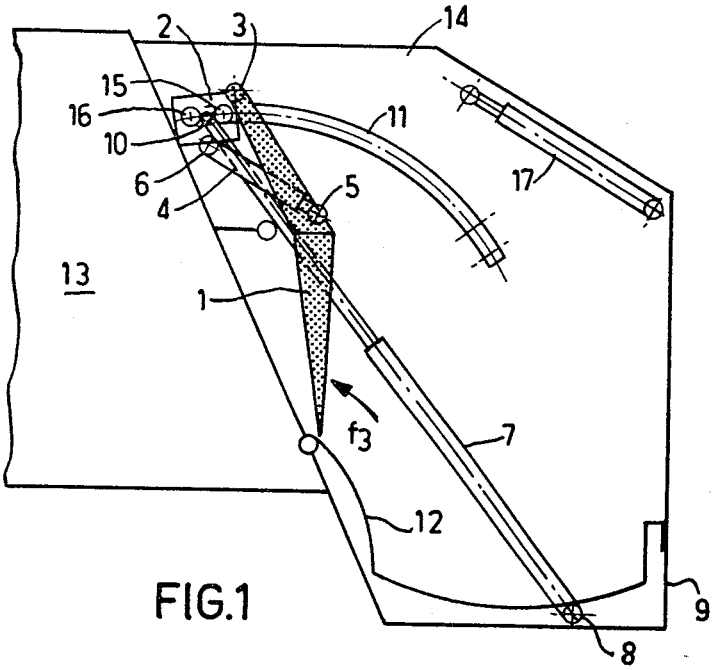
FIG. 1 is a diagrammatic elevation of the novel apparatus mounted upon a hopper bay, the left lateral wall of the apparatus as seen from the rear being omitted; this figure shows the loading blade in the position where it closes the receptacle.
Figure 6:
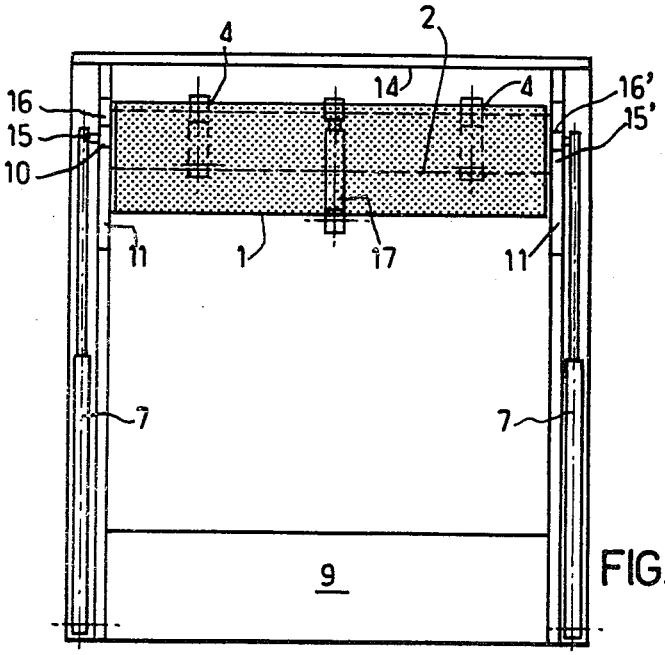
FIG. 6 is a view from the rear showing the blade raised completely (corresponding to the position of FIG. 2).

In FIGS. 1 and 6, there can be seen in the discharging bay 14 a blade 1, the upper part of which is pivotally connected to a beam 2 by pivot 3. This beam 2 runs on curved guides 11 through the intermediary of pulleys 15-15′ and 16-16′. FIG. 6 shows that there are in fact two guides 11, each at one of the lateral ends of the blade 1.

This particular mounting, according to the invention, has the result of allowing the blade 1 to move along the guide 11, while at the same time giving the possibility of pivoting around the pivot axis 3. Therefore, in the high position of the beam 2 (FIGS. 1 and 2), the blade can pivot around the axis 3, as shown by the arrow $f_1$. The first type of blade movement namely sliding along the guide 11, is produced by the action of two parallel cylinders 7, placed at the two lateral ends of the beam 2, as shown in FIG. 6. The cylinder 7 is pivotally connected, by the end 8 of its cylinder body, to the lower part of the hopper 9. The end of the piston of the cylinder 7 is connected by a pivot 10 to the sliding beam 2. Extreme extension of the cylinder, which can be seen in FIG. 2, thus corresponds to the high position of the beam 2 and consequently to the high position of the blade 1. In contrast, complete retraction of the cylinders 7 brings the beam 2 to the lower end of the guide 11, best shown in FIGS. 3 and 4. This corresponds to the low positions of the blade 1.

The second type of movement of the blade 1, namely pivoting about the beam 2, is effected by means of two parallel cylinders 4 mounted on the lateral ends of the blade 1. The end of the body of the cylinder 4 is connected to the beam 2 through the intermediary of a pivot 6 situated away from the axes of the pulleys 15-15′ and 16-16′, while the end of the piston of the cylinder 4 is pivotally connected at pivot 5 to the middle part of the edge of the blade. Thus, whatever the position of the beam 2 on the guide 11, the action of the cylinder 4 can always raise or lower the blade 1. These movements are brought about by pivoting the blade around the pivot 3 under the effect of the traction or pressure exerted at 5 by the cylinder 4. Examples of such rotations are shown by arrows $f_1$, $f_2$ or $f_3$.

The figures illustrate the particular case, which is technically very important, where the compacting apparatus according to the invention is installed at the rear of a container or skip 13 above a hopper bay 9. It will be understood that the apparatus described can be utilized under other conditions, possibly without the hopper. For example, it can serve for collecting charges directly on a surface where they are stored, for example on the ground.

In the embodiment represented, where the material is first discharged into the hopper 9 and then gathered up by the blade 1 in order to be pushed into the interior of the container 13, the preferred configuration of this hopper corresponds to a slightly hollowed or dish-shaped hearth base, so as to cause displacement of the lower edge of the blade 1 while it sweeps or scrapes across the base of the hopper towards the container. On the other hand, it is also preferable for the forward wall 12 of the hopper, directed towards the entry to the container 13, to have a slight convex curvature to the exterior, in order to harmonize with the displacement of the blade 1 when the latter rises, while effecting compression of the charge, towards the position of closure of the container (movement from the position of FIG. 4 to that of FIG. 1).

In order that the material introduced into the container 13 is satisfactorily gathered up by the blade 1, it is necessary for the lower edge of the blade 1 to scrape the base of the hopper 9. It is necessary, however, to provide a certain clearance between this edge and the base, in order to avoid any jamming. This clearance varies with the nature and particularly the size of the matter constituting the material treated. It may be noted, however, that owing to the arrangement according to the invention with pivotal connections to the movable beam 2, the danger of jamming is much less than with known apparatus.

As already indicated above, operation of the compacting apparatus described comprises four successive phases. FIG. 1 represents the closed position, which is taken in the following as the starting point in the cycle of operations. The blade 1 is then at rest, its lower edge level with the upper edge of the wall 12 of the hopper 9 and, for this reason, the entry to the receptacle 13 is closed.

Figure 2:
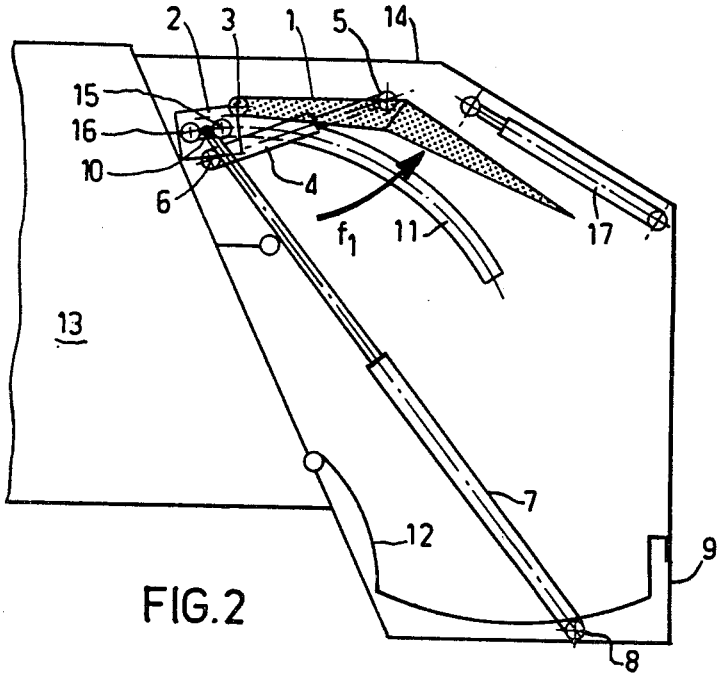
FIG. 2 is a view similar to that of FIG. 1, but shows of the receptacle completely open.

The first operative phase consists in raising the blade 1 from the closed position to that of complete opening, represented by FIG. 2. This movement, shown by arrow $f_1$, is obtained by the action of the cylinder 4, while the beam 2 remains at the top of guide 11. Thus, following this first phase of the cycle, the blade 1 is at rest in its highest position, shown in FIG. 2.

Figure 3:
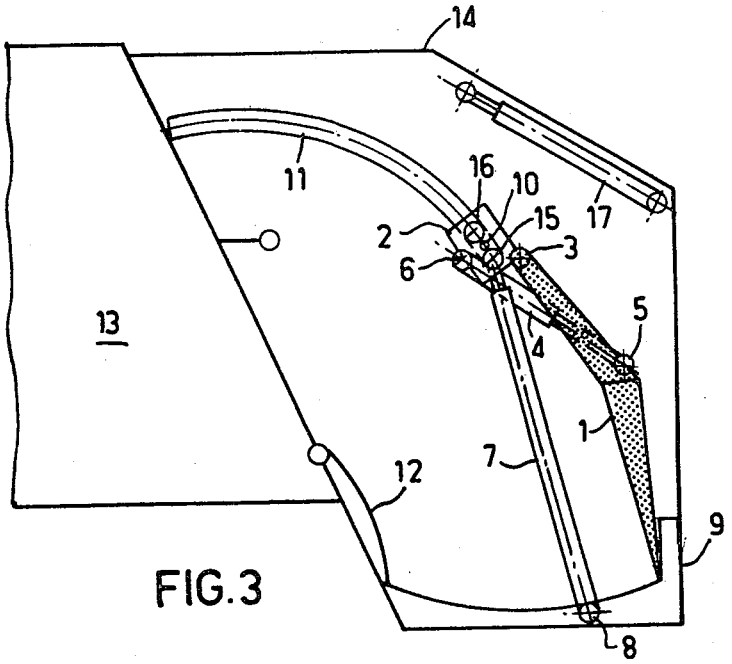
FIG. 3 is a similar view showing the position of the blade at the start of its movement towards the receptacle.
Figure 4:
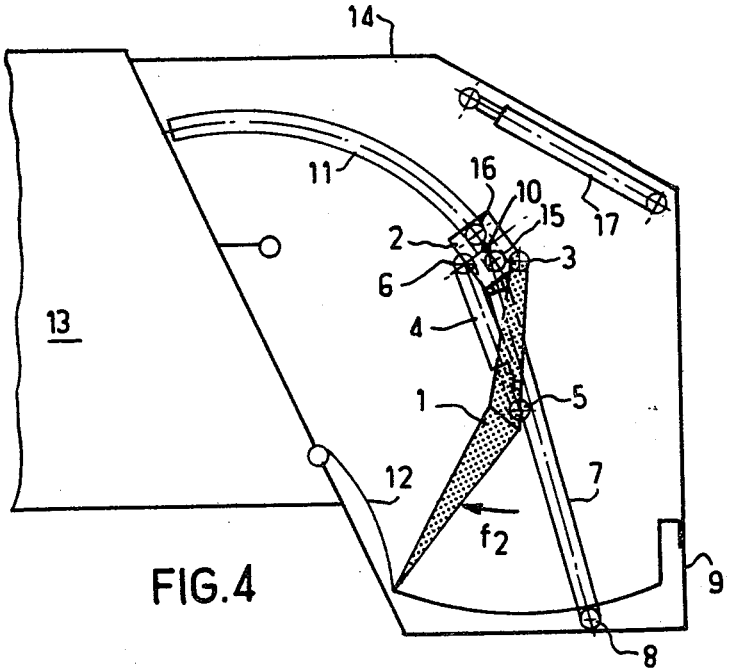
FIG. 4 illustrates the position at the end of the movement of the blade, before closure of the entry to the receptacle.

The second phase consists in making the blade 1 descend from its high position to the lowest (third) position, behind the material which is located on the hopper 9. This movement is obtained by retraction of the cylinder 7, which draws the beam 2 from its highest position to its lowest position at the lower end of the guide 11, as shown in FIG. 3.

Starting from this third position, the blade 1 is made to rotate around the pivot 3 towards the entry to the container, as shown by arrow $f_2$; This constitutes the third phase of the cycle. Following this movement, the blade 1 is located in the position of FIG. 4, after having pushed towards into the container the material which was originally on the hopper 9. The material which at this time is thus ahead of the movement of the blade, is thus compressed ready for loading into the container 13.

Finally, the cylinder 7 again opperates in order to cause a movement of the blade 1 in the direction indicated by arrow $f_3$, thus accomplishing the fourth phase of the operative cycle. For this movement, extension of the cylinder 7 is effected, which moves the beam 2 along the guide 11 to the highest position, namely that shown in FIG. 1. During its rise, the beam 2 raises the pivot 3 of the blade 1 and, consequently, the latter is returned to its starting position, in which it closes the container 13.

Sequential operation of the hydraulic cylinders 4 and 7 is regulated and controlled by known means which allow the desired movement of the blade to be effected at any time.

Figure 5:
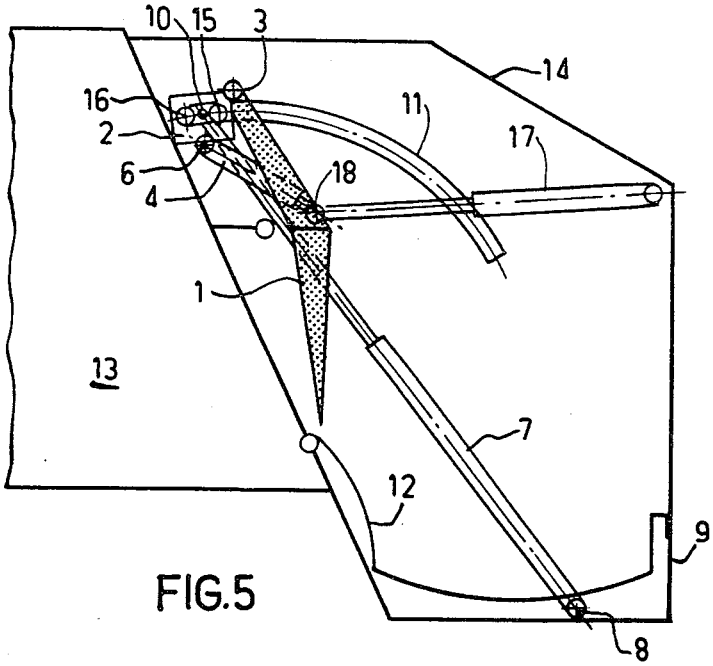
FIG. 5 shows the same position of the blade as in FIG. 1, but with an auxiliary cylinder in operation.

In a variant of the invention, a third cylinder 17 is used to provide extra force to compress the material and force it into the container 13, if such extra force is needed. As shown in FIGS. 1 to 4, this cylinder is held in reserve, at rest, on a rear wall of the bay 14. It does not operate during the four phases of the cycle of loading the material, but can be brought into operation at the end of the fourth phase, that is to say when the blade 1 has closed the entry to the container 13. Often at this time it is desirable to compress further the material introduced into the container 13. As the cylinder 4 may not suffice for this purpose, supplementary pressure is provided by the auxiliary cylinder 17, according to the invention. For, the head of the piston rod on this cylinder 17, which is not attached to and most of the time is not in contact with the blade 1, is applied to the blade 1 and the cylinder body receives the hydraulic pressure necessary to push the blade 1 further forward. It will be understood that the action of coupling the cylinder 17 to the blade 1, as shown in FIG. 5, can be effected by any known means, whether manual, electric or hydraulic. Temporary connection between the head of the cylinder 17 and the blade 1 can be realized, for example, by engaging a spherical head 18 on the piston rod of the cylinder in a hemispherical recess provided in the middle of the blade.

What is claimed is:

1. A loading apparatus comprising:

a hopper, said hopper having a side;

a loading blade having a top and having a bottom edge, said bottom edge extending into said hopper;

moving means for moving said blade through said hopper between a first position in said hopper adjacent said side of said hopper and a second position below in said hopper and laterally displaced in said hopper from said first position and located farther from said side of said hopper; said moving means comprising guide means in said hopper and a slidable transverse beam disposed to move along said guide means and being free of any fixed connection to said hopper; said top of said blade being pivotally secured to said transverse beam at a first location; and said moving means further comprising first hydraulic cylinder means connected between said hopper and a second location on said transverse beam for moving said transverse beam along said guide means, said second location being below said first location when said blade is in said first position; and pivoting means for pivoting said blade in said hopper between a third pivot position at which said blade bottom edge is pivoted nearer said hopper side and a fourth pivot position at which said blade bottom edge is pivoted farther from said hopper side; said pivoting means comprising second hydraulic cylinder means connected between said blade and a third location on said transverse beam that is below said first location when said blade is in said first position; at least one of said first and second hydraulic cylinder means being disposed generally below said transverse beam when said blade is in said first position.

2. An apparatus according to claim 1, wherein said second hydraulic cylinder means is connected to said blade at a location spaced from said first location; and said second hydraulic cylinder means being disposed generally below said transverse beam when said blade is in said first position.

3. An apparatus according to claim 1, wherein said guide means has the shape of a circular arc, concavely curved toward said hopper side.

4. An apparatus according to claim 1, wherein said first hydraulic cylinder means is disposed generally below said transverse beam when said blade is in said first position.

5. An apparatus according to claim 3, wherein said transverse beam is arranged to move along said guide means by means of pulley means on said transverse beam; said first location being above said pulley means when said blade is in said first position.

6. An apparatus according to claim 5, wherein said second hydraulic cylinder means is connected to said blade at a location spaced from said first location; said second hydraulic cylinder means being disposed generally below said transverse beam when said blade is in said first position and said third location being below said pulley means when said blade is in said first position.

7. An apparatus according to claim 6, wherein said second hydraulic cylinder means is connected to said blade at a point toward the middle of said blade between said top and said bottom edge.

8. An apparatus according to any of claims 1, 2 or 3, further comprising additional hydraulic cylinder means for providing an auxiliary force urging said blade into said first position and, simultaneously, into said third pivot position.

9. An apparatus according to any of claims 1, 3 or 7, wherein said hopper has a surface for holding material to be loaded and said surface is profiled such that said bottom edge of said blade moves along said surface as said blade moves between said third and fourth pivot positions while said blade is in said second position.

10. A loading apparatus comprising:

a hopper, said hopper having a side;

a loading blade having a top and having a bottom edge, said bottom edge extending into said hopper;

moving means for moving said blade through said hopper between a first position in said hopper adjacent said side of said hopper and a second position below in said hopper and laterally displaced in said hopper from said first position and located farther from said side of said hopper; said moving means comprising guide means in said hopper and a slidable transverse beam disposed to move along said guide means; said top of said blade being pivotally secured to said transverse beam at a first location; and said moving means further comprising first driving means connected between said hopper and a second location on said transverse beam for moving said transverse beam along said guide means, said second location being below said first location when said blade is in said first position; and pivoting means for pivoting said blade in said hopper between a third pivot position in which said blade bottom edge is pivoted nearer said hopper side and a fourth pivot position in which said blade bottom edge is pivoted farther from said hopper side; said pivoting means comprising second driving means connected between said blade and a third location on said transverse beam that is below said first location when said blade is in said first position; at least one of said first and second driving means being disposed generally below said transverse beam when said blade is in said first position.

* * * * *

UNITED STATES PATENT AND TRADEMARK OFFICE

CERTIFICATE OF CORRECTION

PATENT NO. : 4,298,306

DATED : November 3, 1981

INVENTOR(S) : Emile Chaudorge

It is certified that error appears in the above-identified patent and that said Letters Patent are hereby corrected as shown below:

On cover page, at [73], line 1, in the Assignee's name, change "Chauoronnerie" to --Chaudronnerie--.

Signed and Sealed this

*Nineteenth* Day of *January 1982*

[SEAL]

*Attest:*

GERALD J. MOSSINGHOFF

*Attesting Officer*

*Commissioner of Patents and Trademarks*